US006143373A

United States Patent [19]

Ovshinsky

[11] Patent Number: 6,143,373

[45] **Date of Patent: *Nov. 7, 2000**

[54] METHOD OF SYNTHETICALLY ENGINEERING ALLOYS FORMED OF HIGH MELTING POINT AND HIGH VAPOR PRESSURE MATERIALS

[75] Inventor: Stanford R. Ovshinsky, Bloomfield Hills, Mich.

[73] Assignee: Energy Conversion Devices, Inc., Troy, Mich.

[ * ] Notice: Under 35 U.S.C. 154(b), the term of this patent shall be extended for 514 days.

[21] Appl. No.: 08/584,642

[22] Filed: Jan. 11, 1996

[51] Int. Cl.[7] ..... C23C 14/08

[52] U.S. Cl. ..... 427/529; 427/399; 427/530; 427/569; 427/576; 427/585

[58] Field of Search ..... 427/529, 530, 427/569, 576, 585, 399

[56] References Cited

U.S. PATENT DOCUMENTS 4,354,909 10/1982 Takagi ..... 427/531

*Primary Examiner*—Bernard Pianalto

*Attorney, Agent, or Firm*—David W. Schumaker; Marvin S. Siskind; Philip H. Schlazer

[57] ABSTRACT

A process for fabricating synthetic materials by atomic alloying of a host material. Energetic high vapor pressure modifier elements or species are introduced into the host matrix of a fluidic precursor high metling point material so as to obtain an engineered material characterized by a range of controllable optical electrical, thermal, chemical or mechanical properties not exhibited by either the modifier or the precursor material. The method for forming a synthetically engineered material by forming a fluid host matrix material on a moving substrate surface, such as a wheel; directing a plurality of discrete fluid modifier materials, activated or unactivated, in a stream, as from a nozzle, toward the substrate surface in a direction such that it converges with the host matrix material to produce a ribbon of modified material.

21 Claims, 5 Drawing Sheets

METHOD OF SYNTHETICALLY ENGINEERING ALLOYS FORMED OF HIGH MELTING POINT AND HIGH VAPOR PRESSURE MATERIALS

FIELD OF THE INVENTION

This invention relates generally to synthetically engineered materials and more particularly to the fabrication of novel classes of materials in which at least one of the precursor components can be a high melting temperature material and a second of the precursor species can be a high vapor pressure material, which materials are synthesized from energetic species so that the resultant material exhibits a range of mechanical, chemical, optical, thermal and electrical properties heretofore unattainable.

BACKGROUND OF THE INVENTION

The instant invention is predicated upon the world's need for materials which possess a range of characteristics not present in naturally-occurring materials. Only through the synthetic engineering of uniquely propertied materials, can technological progress be freed from the constraints previously imposed by natural. With the constraints of nature's symmetry have been destroyed, the fabrication of materials having nonstoichiometric compositions, unique orbital configurations and variant bonding becomes possible.

The present invention provides for the fabrication synthetic materials which are particularly engineered to accomplish any desired task. In order to accomplish such an ambitious goal, it is necessary to introduce component species which have been preferentially incorporated in various conditions including excited species which can be individually inserted in special bonding configurations. The synthetically engineered electronic and chemical bonding configurations of those species in that host matrix are altered and permanently preserved. For example, completely novel non-equilibrium non-stoichiometric states can be frozen into a stable condition. It should be noted that the term "component" or "component material" as used herein refers to any species which participates in the interactions leading to the final synthetically engineered material, regardless of whether that species is physically present in the final product. Accordingly, components can include, inter-alia, inert gases or other species which transfer energy to, or otherwise influence the formation of the material.

Rapid quenching been described in the literature. By rapidly quenching precursor material from a non-solid state, certain non-equilibrium states and local bonding orders characteristic of the precursor material state can be preserved in the quenched state. In contrast thereto, the same precursor material, more slowly cooled from a non-solid to a solid state, will form a material which does not exhibit the non-equilibrium states and local bonding orders possible for the rapidly quenched material. Typically, the non-equilibrium material produced by rapid quenching will contain one or more phases characterized by disordered, amorphous, microcrystalline, nanocrystalline or polycrystalline structures.

Rapid quench techniques have heretofore been used to incorporate one or more "modifying" elements into the host matrix of a preselected material, thereby providing for the alteration of one or more of the physical, chemical, thermal, electrical or optical properties of that host material in a preselected manner. However, it was doubtful that said alteration could be accomplished without adversely affecting other properties which, in naturally occurring or unmodified materials, are seemingly interrelated to and dependent upon the altered properties. This principle will be referred to hereinafter as "modification". In other words, modification will be defined, for purposes of the instant invention, as the introduction of a modifying species into the host matrix of a precursor material for the purpose of uncoupling otherwise interrelated properties of that host matrix material. Modification will therefor affect at least the electronic configurations of the host matrix material so that physical and electronic transport properties of the material can be altered.

It is to be noted that various other methods are available by which modifying elements or species can be added to the host matrix of a precursor material. For instance, modified amorphous materials have heretofore been made by, e.g. thin film processes, chemical vapor deposition, sputtering and cosputtering, glow discharge, and microwave glow discharge. These methods of modification, the modified materials thereby obtained and the unique properties attained by modification are described in, for example, U.S. Pat. No. 4,177,473 to Stanford R. Ovshinsky for Amorphous Semiconductor Member and Method of Making the Same; U.S. Pat. No. 4,177,474 Stanford R. Ovshinsky for High Temperature Amorphous Semiconductor Member and Method of Making the Same; U.S. Pat. No. 4,178,415 to Stanford R. Ovshinsky and Krishna Sapru for Modified Amorphous Semiconductors and Method of Making the Same; and U.S. Pat. No. 4,520,039 to Stanford R. Ovshinsky for Compositionally Varied Materials and Methods for Synthesizing the Materials. Magnesium-based hydrogen storage alloys are described in U.S. patent application Ser. No. 08/259,793 filed Jun. 14, 1994 titled Electrochemical Hydrogen Storage Alloys and Batteries Fabricated From MG Containing Base Alloys. The disclosures of these patents are incorporated herein by reference.

The modified materials disclosed in the aforementioned patents are to be formed in a solid host matrix having structural configurations which have local rather than long range order. A modifier species may be added to the host matrix of the precursor material, said species having orbitals which interact with the orbitals of the host matrix resulting in the substantial modification of the electronic configurations of the host matrix of the precursor material. The atoms used for modification need not be restricted to "d band" or "f band" atoms, but can be any atom in which the controlled aspects of the interaction with the local environment and/or orbital overlap plays a significant role physically, electronically, or chemically so as to affect physical properties. The elements of these materials can offer a variety of bonding possibilities due to the multidirectionality of d-orbitals. For instance, in electrochemical electrode material, the multidirectionality ("porcupine effect") of d-orbitals provides for a tremendous increase in density and hence active storage sites.

Of particular interest relative to the instant invention is a disclosure which relates to the modification of the host matrix of precursor materials by a melt spinning process, said disclosure found in U.S. Pat. No. 4,339,255 to Stanford R. Ovshinsky and Richard A. Flasck for Method and Apparatus for Making a Modified Amorphous Glass Material, the disclosure of which is incorporated hereinto by reference. This '255 patent describes a method and apparatus for introducing a fluidic modifier into a host matrix, said fluidic modifier optionally containing one or more active gases, such as oxygen, nitrogen, silicon tetrafluoride, or arsine. The synthetic materials made by the disclosed process can be metallic, dielectric, or semiconductor modified amorphous glass materials. The modified synthetic materials can range from alloys, to materials with varying degrees of alloying and modification, to materials in which only modification and doping actions exist. While the '255 method provides for such modification species to be incorporated at various intervals or layers, at different rates and in different sequences; the number of species incorporated, the number and interval of layers and the rates and sequence of introduction are limited.

While the method disclosed in U.S. Pat. No. 4,339,255 permits the fabrication of modified ceramic materials, the process utilized to make the resultant material is that of melt spinning onto the peripheral surface of a chill wheel. As described hereinabove, melt spinning is a rapid quench process and can have quench rates as high as 108 degrees Centigrade per second. However, melt spinning is actually one of the slower rapid quench techniques, especially when compared to more rapid techniques such as sputtering. Therefore, it has heretofore not been possible to produce modified bulk materials at very high quench rates. It would, of course, be desirable (for production purposes, as well as for the fabrication of the highest quality modified materials) to fabricate modified bulk materials at very high quench rates, since the resultant materials would be characterized by a range of properties heretofore unobtainable.

Therefore, the instant invention relates to innovative fabrication techniques for the synthesis of novel classes of modified materials, which techniques do not suffer from any of the limitations imposed by the Flasck '255 process or other similar quench processes. More particularly, the instant invention includes the ability to simultaneously incorporate into a synthetically engineered material, metals or ceramics characterized by a very high melting point and other materials, such a magnesium, characterized by very high vapor pressure. Further, the instant invention provides for the modified element to be introduced, whether activated or not, at any point downstream of the crucible so as to control the degree and reactivity of its diffusion in the host matrix. Additionally, the melt spinning process used in the '255 patent permits only a rather limited rate of diffusion of the modifier species into the host matrix. Thus, it is not possible to use the method disclosed in that patent to fabricate a class of materials whose properties are purposely engineered on an atomic level.

In contrast to said heretofore developed rapid quench processes, the instant invention provides for the fabrication of synthetically engineered materials having a liquified host matrix into which energetic modifying elements are introduced. Due to the fact that the fabrication process of the instant invention may be repeatably cycled with a variety of host matrix precursors, successively deposited host matrix material may be repeatedly changed with the same modifier or sequentially changed with varying modifiers to develop either a multilayered, compositionally varied body of bulk material or a single homogenous body of bulk material which can be built to relatively thick dimensions. Because the process of the instant invention requires the interaction of the host matrix of the precursor material and the modifier material to occur during exposure to the atmosphere and while the modifier material is maintained in an activated state, both high quench rates and high diffusion rates are obtained. By incorporating the energetic modifier species into the host matrix at high diffusion rates in proper sequence, by specially controlled background environment, it becomes possible to fabricate a truly atomically alloyed synthetically engineered material, which material may include constituents of both high and low vapor pressure elements.

These and other objects and advantages of the instant invention will become clear from the drawings, the detailed description and the claims which follow.

BRIEF SUMMARY OF THE INVENTION

By controlling the constituents, sequence of introduction, degree of activation and atomic configurations of a synthetically engineered material, the electrical, chemical, thermal or physical characteristics of the material are independently controllable. D-band or multiple orbital modifier elements, introduced into a molten host matrix in an excited state, enable the modified material to have stable, but non-equilibrium orbital configurations frozen in by the independent-ly controllable quench rate.

In a melting process the relationship and cooling rate of the host matrix and added element(s) would allow the added element(s) to be incorporated in the normal structural bonds of the matrix. In the processes of the instant invention they become modification elements as described in the above patents. The timing of the introduction of the modifier element(s) can be controlled independently of other fabrication parameters. The flow rate of the modifier element can be controlled and may be varied or intermittent and may incorporate modifier(s), including excited gaseous modifier element(s) in the stream or environment. By independently controlling the environment, quench and flow rates and timing, a new bulk material or alloy can be formed with desired properties, which material does not have a crystalline analog.

Also, in one preferred embodiment of the invention, said host matrix material and said modifier material are directed toward said substrate through first and second nozzles each of which is positioned to direct fluid material at said substrate at an angle preferably between 90° and 30° (and more preferably between 45° and 60°) to said substrate and one of said nozzles is positioned behind the other of said nozzles such that both nozzles are in substantially the same or different vertical planes, and such that said streams from said nozzles converge or sequentially converge in said vertical plane.

There is also disclosed herein a method of fabricating a synthetically engineered solid material, said method comprising the steps of: providing a fluidic stream of a first component of the material; subjecting the fluidic stream of the first component to an energized diffusible second component of the material; diffusing said second component through at least a portion of the fluidic stream; and rapidly quenching the diffused fluidic stream. In this manner, the second component interacts with the first component so as to form a synthetically engineered solid material exhibiting a range of properties different from the properties of either individual component. The fluidic stream of the first component is preferably a liquid metal. Preferably, a stream of an energized gaseous material is directed to impinge upon the fluidic stream of the first component, said gaseous material selected from the group consisting essentially of nitrogen, oxygen, halogens, hydrocarbon gases, low vapor pressure metals such as magnesium, inert gases, hydrogen, vaporized alkaline metals, and combinations thereof. The second component may be energized by forming a plasma therefrom, by ionizing the second component, by radicalizing the second component, by thermally activating the second component, by photoactivating the second component, by catalytically activating the second component, or by utilizing a high pressure environment.

The energized gaseous stream is brought into contact with the fluidic stream of the first component substantially in the direction of movement in the first component so that momentum is transferred from said gaseous stream to said fluidic stream of said first component. The velocities of the component streams can be individually controlled, however, the contact between the two streams must be maintained for a significant length of time to attain the desired degree of diffusion. In a preferred embodiment, the first component is liquified in a crucible and ejected from the crucible in a fluidic stream. In another embodiment, the first component may overflow from the top of the crucible. The aperture formed in the crucible may be regularly or irregularly shaped.

The fluidic stream of the first component can be subjected to additional energy for enhancing the diffusion of the second component through a portion of the bulk of the host matrix of the first component. The external energy may be provided by electrical energy, magnetic energy, thermal energy or optical energy. Additional fluidic streams of additional precursor components may be directed into contact with the fluidic stream of the first component. The third or additional components may be either sequentially or simultaneously directed into contact with the first component. A quenched surface may be utilized to freeze the properties of the modified material after the interaction of the components has been completed. AC energy, microwave energy, RF energy or DC energy may be utilized to form the plasma which activates the second component.

The fluidic stream of said first component may be subjected to a burst of energy for enhancing the diffusion of the second component through the host matrix of the first component. The energy may be electromagnetic, optical, thermal or of other origin. Energized, diffusible third, fourth, fifth, etc. components of the synthetically engineered material may also be provided, in which case the fluidic stream of said first component may also be exposed to the second, third, fourth, fifth (etc.) energized diffusible components prior to quenching. Only after interacting with said second and additional components, may said modified material be deposited onto a quench surface for freezing the properties into said material.

Also disclosed is a method of fabricating a synthetically engineered solid material, said method comprising the steps of: providing a moving surface; contacting at least a portion of the moving surface with a fluidic first component of the material; contacting the first component portion of the moving surface with a fluidic second component of the material; and catalytically introducing an energized third component of the material, said material adapted to diffuse into a component selected from the group consisting essentially of (1) the first component, (2) the second component and (3) the first and second components. As the third component diffuses through and catalytically interacts with the selected component, it forms the synthetically engineered solid material.

The moving surface may take the form of e.g., a moving belt, the surface of a drum, or a rotating wheel. Either one or both of the first and second fluidic components may form part of a fluidic stream, which stream has been melted and ejected from a crucible. Alternatively, either one or both of the first and second fluidic components may be provided as an immersible bath or a spray. Alternatively, a plurality of moving surfaces may be provided in a multi-deposition-step process. The energized third component may be catalytically introduced to diffuse into the first component as or after it comes into contact with a portion of the moving surface. Alternatively, the energized third component may be catalytically introduced into the fluidic second component of the material before or as it comes into contact with the first component portion of the moving surface. Alternatively, the energized third component may be catalytically introduced to both the fluidic first and second components after they have contacted each other.

BRIEF DESCRIPTION OF THE DRAWINGS

in FIG. 6A microwave horns are employed, in FIG. 6B r.f. powered electrodes are employed, in FIG. 6C inductive heating coils are employed and in FIG. 6D photoactivating lamps are employed.

DETAILED DESCRIPTION OF THE INVENTION

I. Synthesis of Single Layered Material

Figure 1:
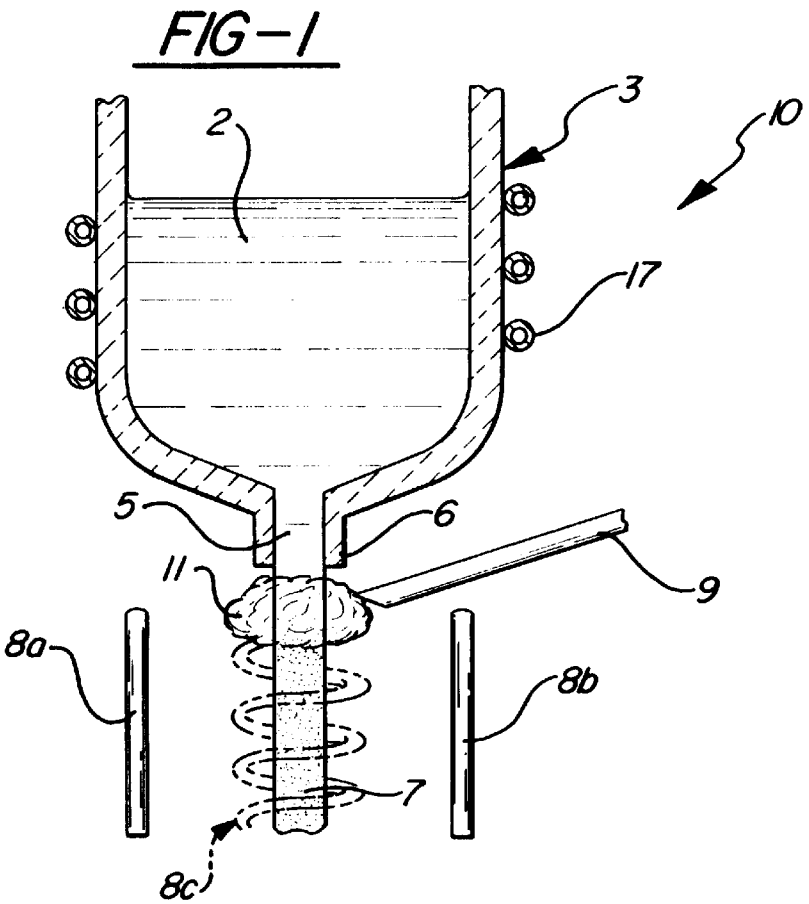
FIG. 1 is a schematic, cross-sectional view of the crucible and stream of liquified material depicting the utilization of electromagnetic energy to establish eddy currents for promoting the diffusion of said energized modifier material into the most matrix of said liquidified material.

The method of the instant invention may be more particularly understood in view of the detailed description which follows with appropriate reference in the drawings. FIG. 1 shows a deposition station generally depicted by the reference numeral 10, said station adapted to fabricate a synthetically engineered material formed of, for example, one or more high melting temperature metals such as nickel and one or more high vapor pressure elements such as magnesium. More particularly, the deposition station 1 includes a crucible 3 in which a first component of a precursor material (from which the host matrix is formed) can be liquified as by inductive heating coils to form a liquified first component 2 and discharged through an aperture 5 formed in the bottom surface thereof. The liquified first component 2 may then form a fluidic stream 7, which stream is ejected through the regular or irregularly-shaped aperture 5. Also associated with the deposition station 1 is a nozzle 9 from which is discharged an energized, diffusible second component of the material to be synthesized, thereby forming a readily diffusible stream 11 of the second component of the engineered material. As detailed hereinafter, it is essential that the second component be introduced to the fluidic stream of the first component in a highly active state.

According to one embodiment of the present invention, the first component of the synthetically engineered material, which component may include nickel, iron, aluminum, chromium, silicon, etc., is melted within the crucible 3. Melting may be accomplished by resistive heating, inductive heating or any other technique which will not add impurities to liquified material. In some instances, the first component will normally be a liquid and consequently no or little external heat need be applied. Regardless of its room temperature state, the now liquified first component 2 is discharged from the crucible 3, through aperture 5, thereby forming a liquid fluidic stream 7 emanating therefrom. It is noteworthy that the first component will be a lower melting temperature material than and be non-reactive with the material from which the crucible is fabricated. Only in this manner is it possible to prevent impurities associated with the crucible from contaminating the liquid stream.

The fluidic stream 7 of the first component of the engineered material is then subjected to the energized second component of that engineered material. In one form of the subject invention, the second component may be a high vapor pressure material such as magnesium or a catalytic material such as palladium or platinum. Energization of the second component may be accomplished by the input of electrical, photo-optical, magnetic, photochemical, chemical or thermal energy to that component. For example, the second component may be exposed to an electromagnetic energy field such as a microwave, radio frequency or other alternating current field. It may similarly be energized by a D. C. field so as to form an excited plasma. Energization may be photochemical, i.e., the component is irradiated with the appropriate wavelength of light to produce excited species therefrom. Thermal energy may similarly be used for the production of excited species from the second species. In some cases catalytic activation may be employed; as for example, molecular hydrogen gas may be brought into contact with platinum or another catalytic material to produce energized atomic hydrogen. More specific illustrations and descriptions of the various energization structures will be provided hereinbelow with specific reference to FIGS. 6A–6D.

Regardless of the method employed, excitation of the second component will produce ions, radicals, molecular fragments, and/or stimulated neutral species therefrom. As used herein, the term "energized species" will refer to any atom, molecule or fragment thereof having its reactivity increased, such increase being without regard to the manner in which said increase occurs. Further, the second component may be exposed to the activating energy or catalytic material at a point remote from the nozzle 9 or even within the nozzle itself. For example, a source of electromagnetic energy such as an electrode, waveguide or spark gap can be included within the structure of the nozzle. The important aspect of activation is that the species remain energized until the downstream diffusion with the host matrix of the second component has been completed.

The energized, diffusible second component is discharged through nozzle 9 in close proximity to the fluidic stream 7 emanating from the crucible 3, thereby forming an activated region, e.g., a plasma of activated species 11 which substantially surrounds the fluidic stream 7. The second component, because of its activated state and the molten state of the first component, readily diffuses into and interacts with the fluidic stream 7, so that, when cooled, a synthetically engineered solid material exhibiting a range of properties different from the properties of either component thereof is formed.

The deposition apparatus may be enclosed in a chamber. This chamber is not necessary for all fabrication processes; however, in many instances it may be desirable to carry out the fabrication of specific synthetically engineered materials in a controlled environment. For example, the chamber, may be filled with an inert gas such as argon for the purpose of shielding the fluidic streams from atmospheric contaminants. In other instances, the chamber may be evacuated to accomplish the same objective. In still further instances, the reaction and/or diffusion of the components may be facilitated by conducting the process in a pressurized atmosphere and at elevated temperatures. Of course, an elevated ambient temperature would maintain the liquid state of the first component for longer periods of time.

It should be noted that the fluidic stream 7 may be optionally discharged from the crucible under pressure. In the FIG. 1 embodiment, a source of electromagnetic energy, such as spaced electrodes 8*a* and 8*b* coupled to a source of r.f. energy provide bursts of energy to the fluidic stream 7 discharged from the crucible 3. Alteratively, an r.f. frequency induction coil 8*c* (shown in phantom) may be configured to substantially surround said fluidic stream 7 at a position downstream of its discharge from the nozzle 6. The spaced electrodes of the induction coil provide additional energy for enhancing the reactivity and diffusion of the second component into the first component of the synthetically engineered material. Additionally, the induction coil or spaced electrodes may be employed to create eddy currents within the fluidic stream, which currents serve to stir or mix the molten material, thereby maintaining its reactive nature and promoting its homogeneous reaction with the second component. In an alternate embodiment, said eddy currents can be provided by the use of a magnetic field imposed across said fluidic stream 7 whereby motion of the stream and/or motion of the magnets operate to create the requisite forces by which the eddy currents are initiated and sustained.

In some instances it would be desirable to include an additional electrode (not shown) proximate the molten stream 7 for purposes of enhancing mobility of selected ions of the activated second component into the stream. In some cases, the material forming the fluidic stream 7 will be of sufficiently high conductivity to enable it to be directly biased so as to promote migration of ions thereinto, said stream providing an electrolyte for the ions to move in. Regardless of the manner in which the additional energy is supplied, an energized, diffusible second component of the engineered material is simultaneously discharged from the nozzle 9, as previously described with reference to FIG. 1 and the fluidic stream 7 of the first component 2 is subjected to the diffusing effects of that second component 11 to form the body of synthetically engineered material.

In one preferred embodiment of the invention illustrated in FIG. 1, the molten first component 2 of the engineered material is discharged from the crucible 3 through the nozzle 6, under pressure, thereby forming the fluidic stream 7. Energy pulses emanating from the r.f. powered electrodes 8*a* and 8*b* create the aforementioned eddy currents in said fluidic stream 7. In this manner, the fluidic stream 7 is maintained in an excited state while it is being exposed to the plasma 11 formed of the energized, diffusible second component of the engineered material. The eddy currents in the fluidic stream 7 promote more rapid diffusion of the energized, diffusible second component thereinto, thereby providing a more uniform and homogeneous host material. Further, the resultant synthetically engineered solid material will exhibit a correspondingly greater degree of homogeneity and uniformity with respect to material properties.

Figure 2:
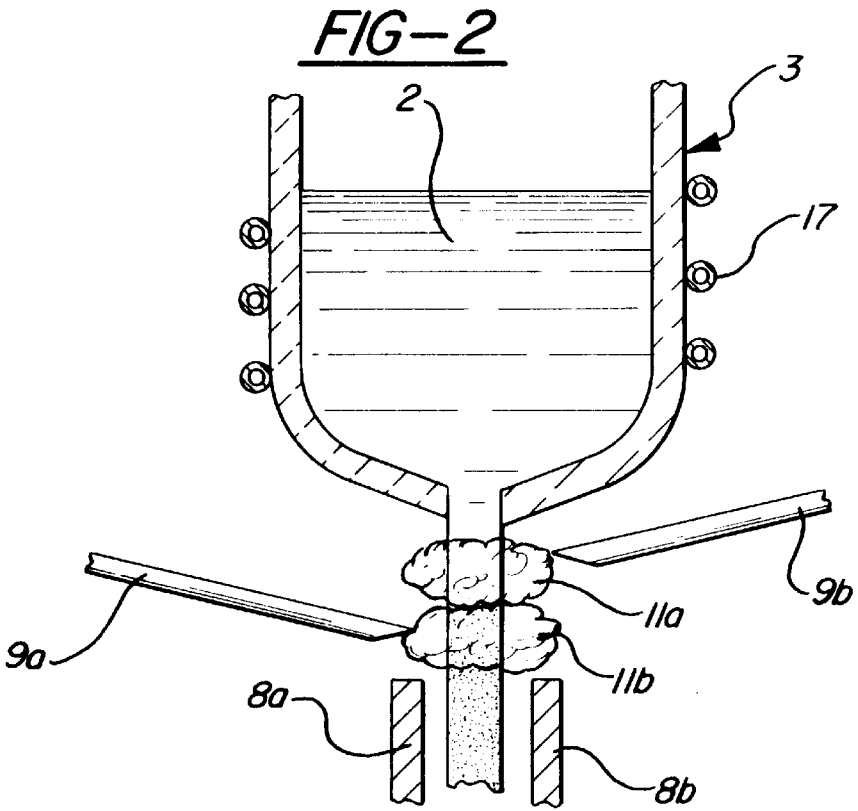
FIG. 2 is a schematic, cross sectional view of the crucible and stream of liquified material illustrated in FIG. 1 and further depicting two diffusible energized modifier materials brought into contact with the storage of liquified material.

An alternative preferred exemplification of the invention is illustrated in FIG. 2 in which there is depicted a first nozzle 9*a* through which is discharged an energized stream of an energized, diffusible second component of the engineered material. However, in contrast to the previous figure, a second nozzle 9*b* is provided to discharge an energized fluidic stream of a third energized, diffusible component of the engineered material. In operation, the fluidic stream 7 of the first component ejected from the crucible 3 is formed as described above and discharged through regularly or irregularly shaped aperture 5. After said discharge, said fluidic stream is contacted by the plasma 11*a* formed of the energized second component and a plasma 11*b* formed of the energized, diffusible third component, thereby forming a synthetically engineered solid material which has been modified by the diffusion and interaction with both the second and third components. While only two diffusible modifiers have been illustrated, it should be understood that additional nozzles can be provided for supplying additional energized modifiers to the fluidic stream formed of the first component. In some instances additional nozzles may be employed to provide unenergized components to the fluid stream for purposes of interacting with, heating, cooling or modifying the material being fabricated. In those instances where the second component is sufficiently reactive, it will be energized chemically by contact with the fluid stream 7 and accordingly no external activation need be employed.

In the particularly preferred embodiments illustrated in the Figures, the fluidic stream 7 is sequentially subjected to the second and then to the third component. However, in other particularly preferred embodiments, the fluidic stream 7 may be simultaneously subjected to the energized second and third components. The simultaneous or sequential interaction of the components will vary in accordance with the desired modifying, grading, doping or alloying to be effected in the final engineered material. It is also to be appreciated by those of ordinary skill in the art that the spacing between the crucible and the introduction of the activated additional components will be selected so as to obtain optimized diffusion and/or microstructural characteristics of the resultant material.

Figure 3:
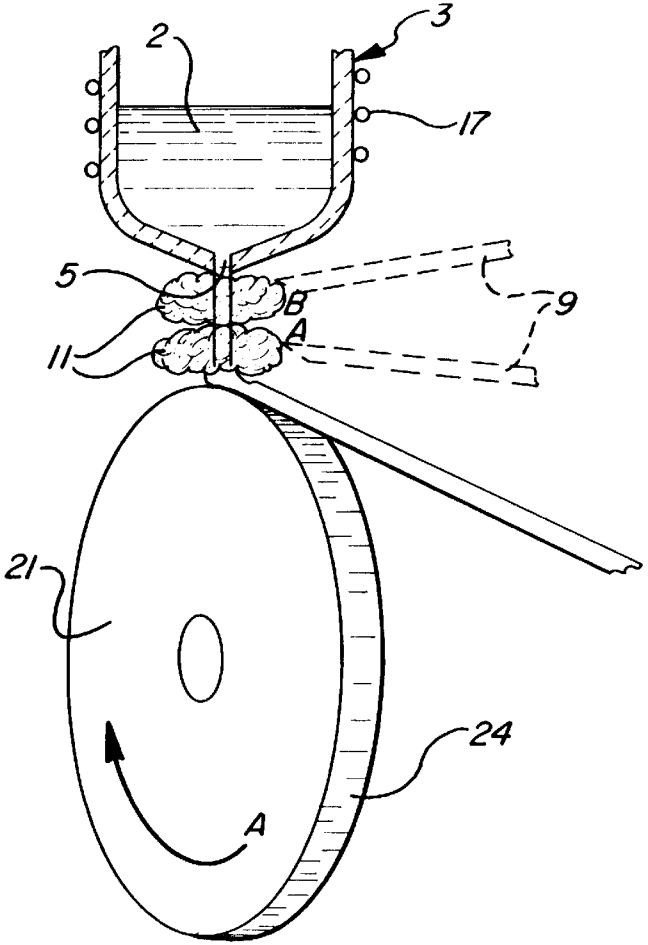
FIG. 3 is a schematic, partially perspective and partially cross-sectional view of liquified material streaming forth from an aperture formed in the bottom surface of a crucible, said liquified material subjected to at least one energized modifier which is adapted to diffuse into the host matrix of the liquified material, said modified liquified material deposited upon the peripheral surface of a chill wheel.

FIG. 3 illustrates still another preferred embodiment of the instant invention, which embodiment includes a quench surface for the rapid solidification of the synthetically engineered material. The apparatus of FIG. 3 includes the crucible 3, which crucible is generally similar to the crucible illustrated and described in the foregoing examples. As illustrated, the crucible 3 is provided with an inductive heating coil 17 for the purpose of melting the first component 2 of the engineered material therein. As mentioned previously, other non-contaminating methods of heating, such as resistive or radiant heating, could be similarly employed. Also included is a nozzle 9, generally similar to the nozzles depicted in and described with reference to the previous figures, said nozzle adapted to discharge and energize the diffusible second component of the engineered material in a plasma-like state 11. The nozzle 9 is shown in FIG. 3, in phantom outline, as ejecting the second component either at a location, A, proximate the surface of the wheel 21 or at a location, B, more remote from the surface of that wheel. The point at which the second component interacts with the first component stream 7 determines the degree of diffusion which will occur.

Where the apparatus of FIG. 3 differs from the aforedescribed apparatus is in the inclusion of a chill wheel 21 for the purpose of rapidly quenching the modified stream into a permanently engineered material. Typically, the chill wheel 21 is formed from a high thermal conductivity material such as copper or aluminum and is rotated rapidly during the material fabrication process to assist in drawing out and cooling said material.

As shown in FIG. 3, a fluidic stream 7 of the first component of the engineered material is directed onto the peripheral surface of the chill wheel 21 from the crucible 3. The first component stream 7 is subjected to the effect of the energized second component of the engineered material. In one embodiment, the second component is projected from the nozzle 9 at a point substantially aligned with the point of introduction of the first component onto the chill wheel 21 (location A). The second component diffuses into and interacts with the first component to produce the synthetically engineered material, which material is rapidly solidified by the conduction of heat therefrom to the chill wheel. Further, the rotational force of the wheel serves the additional function of propelling the thus prepared body of engineered material off the peripheral surface 24 of the chill wheel 21. In a second embodiment, FIG. 3 depicts the second component plasma 11 as interacting with the first component at a point more remote from the point at which the first component is introduced to the chill wheel (location B).

II. Surface Reaction From a Bath or Spray

Figure 4:
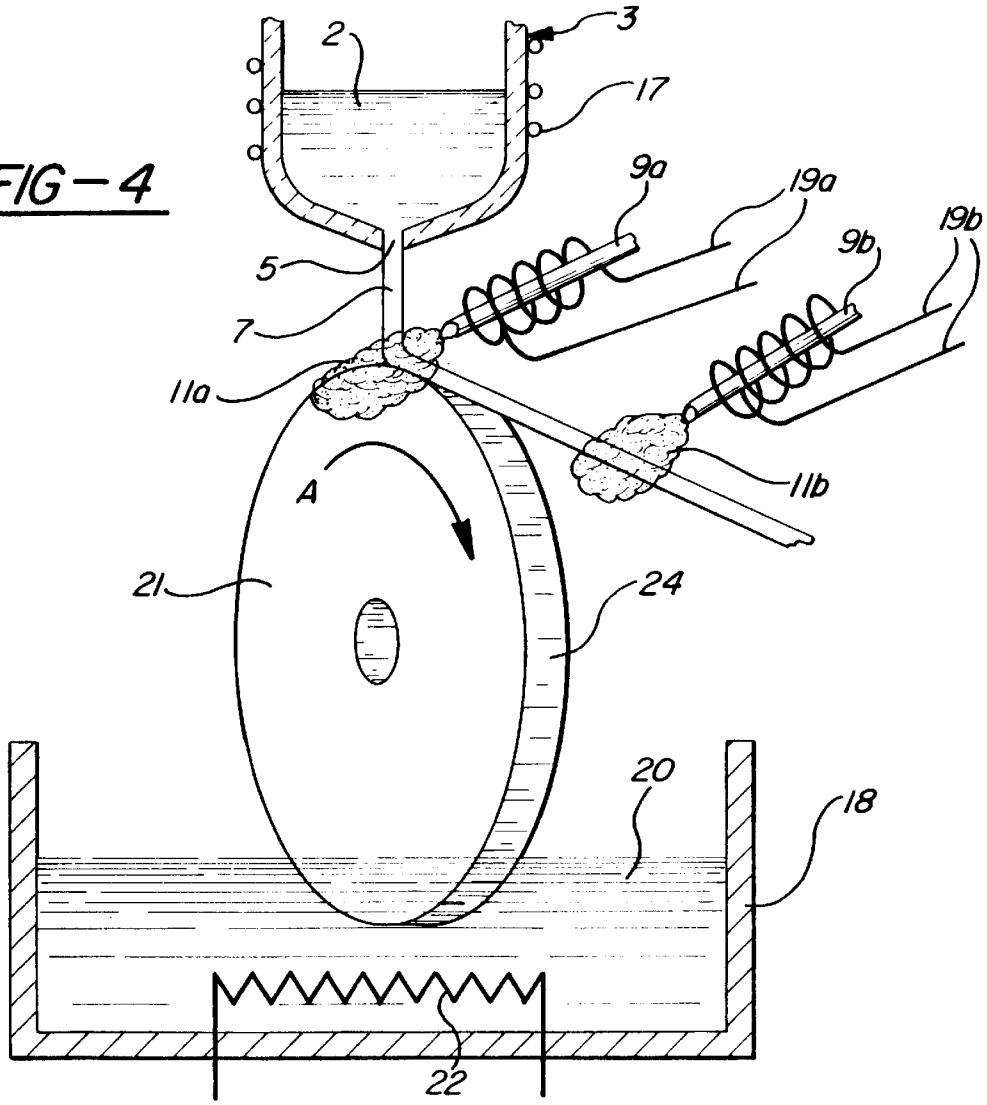
FIG. 4 is a schematic, partially perspective and partially cross-sectional view of a first liquified material streaming forth from an aperture formed in the bottom surface of a crucible and a second liquified stream picked up from a bath by the peripheral surface of a wheel, said streams interacting adjacent the surface of the wheel with first and second energetically introduced species.

Referring now to FIG. 4, there is shown apparatus adapted for the practice of another preferred embodiment of the instant invention. The apparatus of FIG. 4 is generally similar to the apparatus of FIG. 3, and like elements will continue to be referred to by like reference numerals. Where the apparatus of FIG. 4 differs from that of FIG. 3 is in the inclusion of provisions for introducing further components into the body of a synthetically engineered material as that body is fabricated and the use of the wheel for more than a quench surface.

The apparatus of FIG. 3 includes a wheel 21, a crucible 3 having an inductive heating coil 17 associated therewith and a first nozzle 9*a*. These elements are generally similar to those depicted in and described with respect to the foregoing figure and need not be elaborated upon. The apparatus of FIG. 4 further includes a container such as a vat 18 adapted to hold a bath of liquified material 20 therein. As illustrated, the vat 18 includes a resistive heater 22 for maintaining the temperature of the liquified material 20. The apparatus further includes a second nozzle 9*b* having an energy source such as an inductive coil 19*b* associated therewith. The second nozzle 9*b* is generally similar to the first nozzle 9*a* and is also adapted to subject the stream or body of liquified material 7 to a modifier material.

The function of the apparatus of FIG. 4 can best be described with reference to the preparation of a typical synthetically engineered material, in this case a tin and zirconium doped silicon glass member. In preparation for the process, the crucible 3 is first charged with high purity silicon and the induction coil 17 is energized so as to melt the charge of silicon 2 therein. The first nozzle 9*a* is adapted to provide a flux of energized oxygen and the second nozzle 9*b* is adapted to provide a flux of energized hydrogen. The wheel 21 is provided with a peripherally extending contact surface 24 formed of, or clad with, zirconium. The vat 18 is filled with tin tetrachloride 20. In operation, the wheel 21 is rotated through the vat 18 of tin tetrachloride 20 and in passing therethrough picks up a stream of tin-containing material on the surface 24 thereof. The molten silicon is ejected from the aperture 5 in the bottom of the crucible 3 into a fluidic stream 7 and onto the peripheral surface 24 of the wheel 21. This molten silicon stream 7 interacts with both the zirconium wheel surface 24 and the tin tetrachloride present thereupon so as to incorporate those materials into the host matrix of the silicon compound for purposes of alloying, doping and/or modifying same. The molten silicon, having tin tetrachloride and zirconium incorporated into the matrix thereof is subjected to the plasma 11*a* of energized oxygen from the first nozzle 9*a*, which oxygen converts the silicon into a body of silicon dioxide incorporating zirconium and tin tetrachloride therein. The thus formed silicon dioxide body (complete with the aforementioned additions) is next subjected to the effects of the plasma 11*b* of energized hydrogen emitted from the second nozzle 9*b*, said hydrogen adapted to diffuse into the silicon dioxide body, reducing the tin tetrachloride to free tin. In this manner, a body of silicon dioxide having zirconium and tin incorporated therein is prepared.

Obviously this process could be modified by one skilled in the art without departing from the spirit and scope of the instant invention. For example, molten tin may be substituted for the tin tetrachloride in the vat, in which case the heater 22 would have to be energized to maintain the tin in its liquid state. In such an embodiment, the inclusion of activated hydrogen for purposes of reducing the tin tetrachloride would not be necessary. In another alternative embodiment of this process, the wheel 21 could include a peripheral surface 24 made of, or clad with, tin and the vat 18 could contain a zirconium based compound such as a zirconium halide. In still other embodiments, the vat 20 and/or the wheel 21 could be maintained at elevated temperatures so as to facilitate the reaction of the components which combine to form the synthetically engineered material. Furthermore, and as described previously, the position of the nozzles 9*a* and 9*b* could be varied so as to alter the material being fabricated.

The process described with reference to FIG. 4 could be readily adapted for the fabrication of many materials other than silicon dioxide-based materials. Furthermore, the basic process illustrated in FIG. 4 may be expanded or simplified to meet various needs. For example, the vat 18 could be eliminated and the surface of the wheel 24 relied upon solely for the introduction of the components which combine to form the body of engineered material. Alternatively, the wheel 21 could be inert to the process and the vat 18 solely relied upon for component introduction. In some instances, the surface 24 of the wheel 21 may not provide a component of the body being fabricated, but could be made to act as a catalytic surface for facilitating interaction of the components. For example, the wheel surface 24 may be formed of iron, noble metals, ceramics, cermets, or other catalytic materials particularly adapted to enhance interactions thereupon. Furthermore, the apparatus of FIG. 4 may be employed without the crucible 3. In such embodiments, the wheel 21 will suffice to provide a fluidic stream of the first component 20 from the vat 18, which stream will then be subjected to second and succeeding components from the nozzles 9*a* and 9*b*. Still further, the apparatus of FIG. 4 may be modified to include additional nozzles for providing additional components of the engineered material.

II. Synthesis of Multilayered Material

Figure 5:
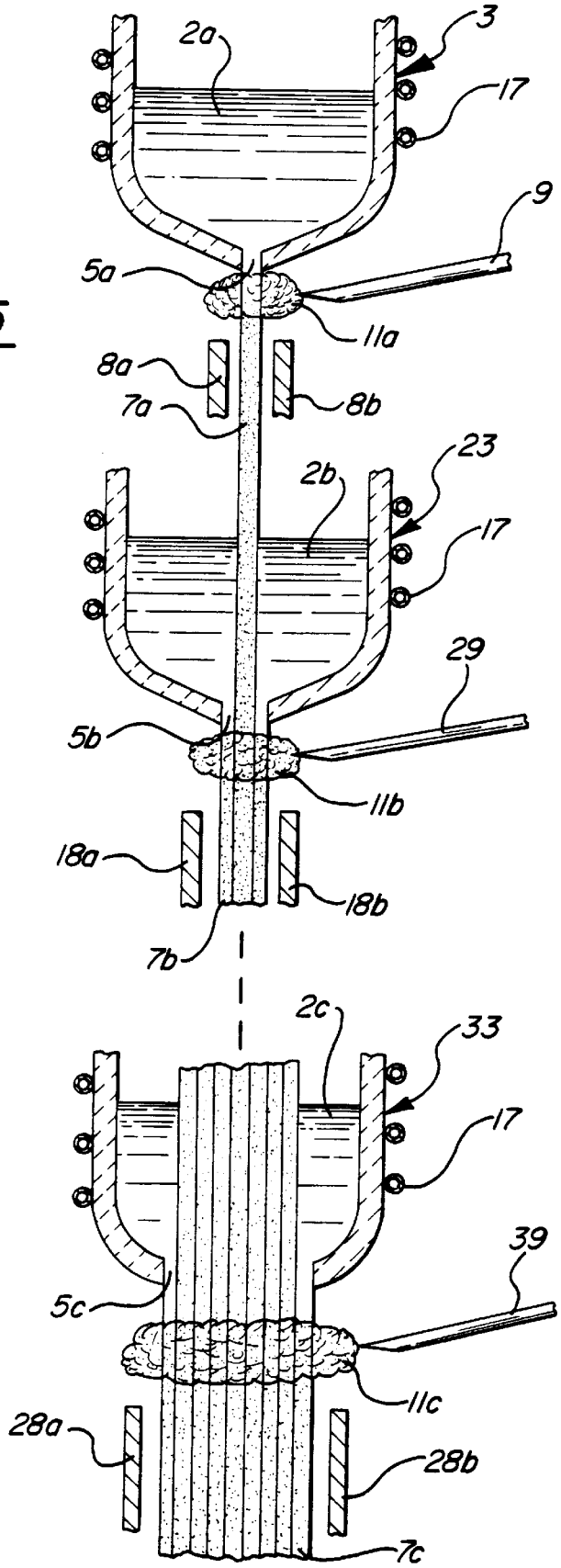
FIG. 5 is a schematic, cross-sectional view illustrating a first deposition station which includes the crucible and stream of liquified material depicted in FIG. 1 and further depicting the utilization of successively arranged stations including similar deposition structures adapted for the fabrication of multi-layered or thicker modified materials.

Referring now to FIG. 5, said figure depicts a multi-deposition station apparatus as operatively disposed for fabricating a relatively thick body of synthetically engineered solid material. The apparatus includes a first crucible 3, generally similar to the crucibles described in the foregoing text, said crucible having associated therewith at least one nozzle 9 for discharging an energized modifying component. The apparatus further includes a second crucible 23 operatively disposed downstream of said first crucible 3 and having at least a second nozzle 20 similarly associated therewith. As indicated by the break line, the apparatus may include any number of additional deposition stations associated therewith. As shown herein, the final station comprises a third crucible 33 operatively disposed downstream of said second crucible 23 and having at least a third nozzle 39 associated therewith.

The apparatus illustrated in FIG. 5 has been found to be particularly advantageous when large bodies of engineered material are to be prepared by the sequential accretion of thin film layers of that material. Apparatus such as that depicted in FIG. 5 is also very useful in preparing multilayered structures comprising thin film layers of differing composition, e.g., graded, alloyed or doped composition. The operation of the apparatus is an extension of the principles described in the foregoing examples, and accordingly, the various modifications elaborated with respect thereto may similarly be applied to the apparatus of FIG. 5.

In operation, the first crucible 3 is loaded with the first component of the engineered material and heated by coils 17 to eject a fluidic stream 7*a* through the shaped aperture 5 formed in the bottom surface thereof. As in the foregoing examples, the fluidic stream of the first component is subjected to a plasma 11*a* formed of an energized, diffusible second component of the energized material ejected from the first nozzle 9. The second component diffuses into and interacts with the fluidic stream 7, thereby forming the body of synthetically engineered material.

The body of engineered material formed at the first deposition station serves as a first core material for the subsequent accretion of thin film layers in the downstream stations of the apparatus. As depicted in FIG. 5, the body of engineered material, referred to henceforth as the core, passes into and through the second crucible 23, which crucible contains a charge of the first component. It should be noted that the core, owing to its interaction with the second component has been transformed into a higher melting point material than the first component and thus may pass through the molten body within the second crucible 23 without being liquified or otherwise degraded. As the core exits the second crucible 23, a fluidic stream 7*b* of the first component from the charge is deposited about the core. This fluidic stream interacts with a plasma 11*b* formed of a second component of the engineered material emanating from the second nozzle 29, said interaction resulting in the deposition of an additional layer of the engineered material 7*b* about the core.

It should be obvious at this point that by sequentially repeating the foregoing steps, relatively large bodies of synthetically engineered material may be built-up. This is further shown with reference to the final crucible 33 of the apparatus of FIG. 5 which is adapted to supply the first component 2*c* for interaction with the plasma 11*c* of the energized second component for depositing final layer 7*c* about the multilayered core ejected from the crucible.

It should be noted that as the body of engineered material grows larger in size, additional nozzles may need to be operatively associated with crucibles at succeeding downstream deposition stations in order to fully envelop the fluidic stream with a sufficient quantity of the energetic second component. While the foregoing description of FIG. 5 related to a body of synthetically engineered material of substantially homogenous composition throughout the bulk thereof and fabricated by utilizing identical first and second components in each of the crucibles and the nozzles, the process may obviously be varied to produce successively deposited layers of differing composition. For example, as the core passes from the first crucible 3, it may be conveyed to a second crucible 23 having a molten material present therein which differs from the molten material present in the first crucible 3. In this manner multi-layered heterogeneous structures may be fabricated.

It should be noted at this point that the cross-sectional configuration of the aperture 5 in the crucible will control the cross-sectional geometry of the body of synthetically engineered material emanating therefrom. In this manner, bodies of various cross-sectional configuration may be fabricated. In some instances it would be desirable to have a body of substantially regular cross-sectional shape, such as a circular, rectangular or oval shape i.e. a symmetrical convex shape in more mathematical terms. In other instances it may be desirable to have a body of substantially irregular cross-sectional shape i.e. a non-convex shape which may even be asymmetric, such as an I-beam shape, for purposes of enhancing catalytic activity, increasing surface area or increasing surface strength. Note, that in order to effectuate such regular or irregular shaping, only the first crucible 3 need have the aperture 5 configured in a particular cross-sectional shape. At succeeding stations, the core produced in the first chamber will act as a template for the accretion of subsequent layers thereupon, thereby producing a large body having the desired cross-sectional configuration.

Note, as being generally applicable to all of the foregoing figures, the fact that the fluidic stream of the first component of the engineered material is of a lower mass than the symmetrically engineered body of that material because the second component has been added to that stream. Due to the laws of conservation of momentum, this factor must be accounted for in the movement of the streams. Since the stream of the first component is ejected from a crucible 3, such as that of FIG. 1, and then interacts with the second component, the body of synthetically engineered material produced therefrom will be heavier (have a greater mass) than the stream emanating from the crucible. Consequently, the body of synthetic material will tend to travel at a lower rate of speed than the fluidic stream (this is true because $m_1v_1$ must equal $m_2v_2$). This effect, if ignored, could cause splattering, bunching, clumping or other non-uniform flow of the first fluidic stream.

In order to overcome these deleterious effects, additional momentum must be provided to the body of synthetical material as it is proceeds from the deposition station. This may be accomplished in numerous ways. One of the most expedient ways (and as previously explained) would be to project the second component of the engineered material from the nozzle at a sufficient velocity and at a proper angle so as to impart additional momentum to the stream of synthetic material. This could be accomplished relatively easily by angling the nozzle with respect to the stream ejected from the crucible. In other instances, the stream of the synthetically engineered material will be drawn from the deposition station onto a take-up reel or drum (as illustrated in FIGS. 6A–6D). By controlling the speed and torque of the drum, sufficient momentum can be conveyed to the stream to prevent the aforementioned flow problems. In those instances where a rapidly rotating chill wheel is used, such as illustrated with reference to FIG. 3, the wheel may also serve the function of imparting, sufficient momentum to the stream to obviate the aforementioned problems.

The apparatus described with reference to the drawings may be advantageously employed to fabricate a wide variety of synthetically engineered materials. Particular utility will be had in the preparation of higher melting compounds such as ceramics and glasses which include alloys having a significantly higher vapor pressure. For example, the apparatus of the instant invention may be employed to prepare bodies of a MgNiAlCoMn alloy material for the negative electrode for a nickel metal hydride battery. It is anticipated that one skilled in the art of material science would be readily able to adapt the processes disclosed herein to prepare a wide variety of synthetically engineered materials of homogeneous compositions as well as of composite and multi-layered compositions having unique optical, electrical, chemical, thermal and structural properties.

III. Activation of Component Streams

As mentioned previously, various types of energy may be utilized in accordance with the principles of the instant invention to activate the various energetic gaseous components of the material being synthesized. FIGS. 6A–6D are illustrative of some such excitation methods.

Figure 6B:
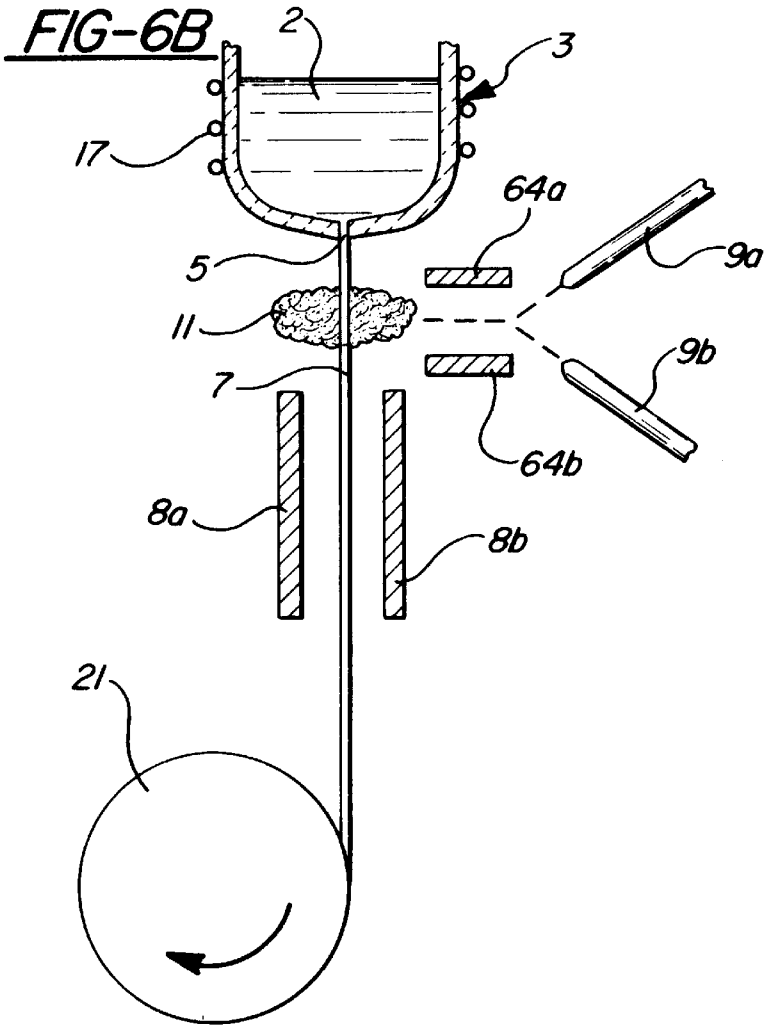
FIGS. 6A–6D are schematic, cross-sectional views of different means for energizing the gaseous components emanating from the nozzles depicted in FIG. 3.
Figure 6A:
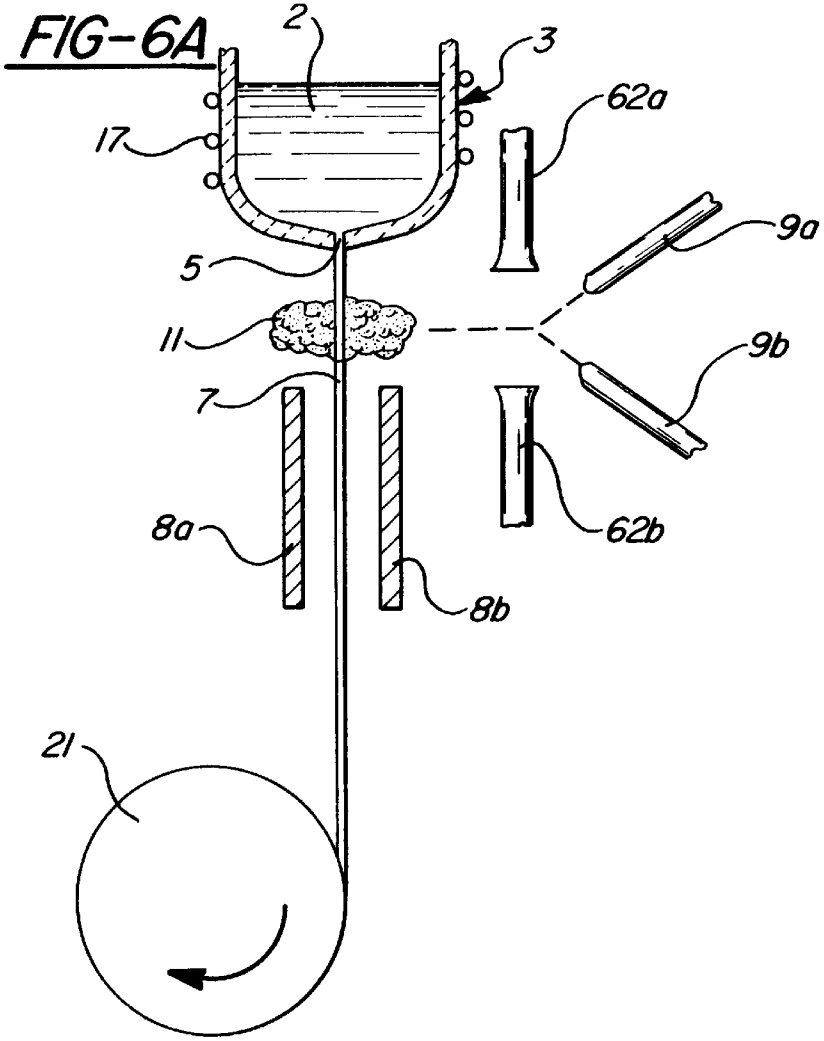

Referring first to FIG. 6A, there is shown an apparatus, generally similar to that of FIG. 1, including therein a crucible 3 heated by an induction coil 17 as adapted to prepare a fiber 7 of synthetically engineered material. While also illustrated in the figure is a take-up reel 60 adapted to collect and wind the fibers 7, FIG. 6A is predominantly intended to illustrate the use of microwaves to excite the components of the engineered material emanating from the nozzles 9*a* and 9*b*. To that end the apparatus includes a pair of spaced microwave horns 62*a* and 62*b* disposed so as to direct microwave energy toward a stream of gaseous reactive components emanating from the two nozzles 9*a* and 9*b*. The microwave horns 62*a* and 62*b* are typical microwave sources, or alternatively free radical generators such as "Woods' horns" as are well known to those skilled in the art. Of course, the horns are operatively connected to a source of microwave energy (not shown). The use of microwave horns provides one particularly advantageous embodiment because the highly active energy transmitted therefrom activates an order of magnitude more species than does radio frequency energy.

The gaseous components exiting from the nozzles 9*a* and 9*b* pass through the field of microwave energy and are excited so as to create a plasma 11 therefrom, which plasma 11 interacts with the primary component in the fluidic stream 7 exiting from the crucible 3. As illustrated, the apparatus further includes a pair of radio frequency energized electrodes 8*a* and 8*b*, as previously discussed, said electrodes disposed to provide additional energy to the fiber 7 for the purpose of maintaining an optimum temperature of the fluidic stream and further facilitating the interaction of the component thereof.

Referring now to FIG. 6B, there is shown apparatus generally similar in operation and structure to that of FIG. 6A; however, energization of the gaseous components of the engineered material in this instance is provided by a pair of radio frequency energized electrodes 64*a* and 64*b* operatively disposed proximate the stream of gaseous components ejected from the nozzles 9*a* and 9*b*. As with the microwave energy embodiment, the radio frequency energy excites the gaseous components to form a plasma 11 therefrom, which energetic plasma facilitates the interaction of those components into the host matrix of the first component.

Figure 6D:
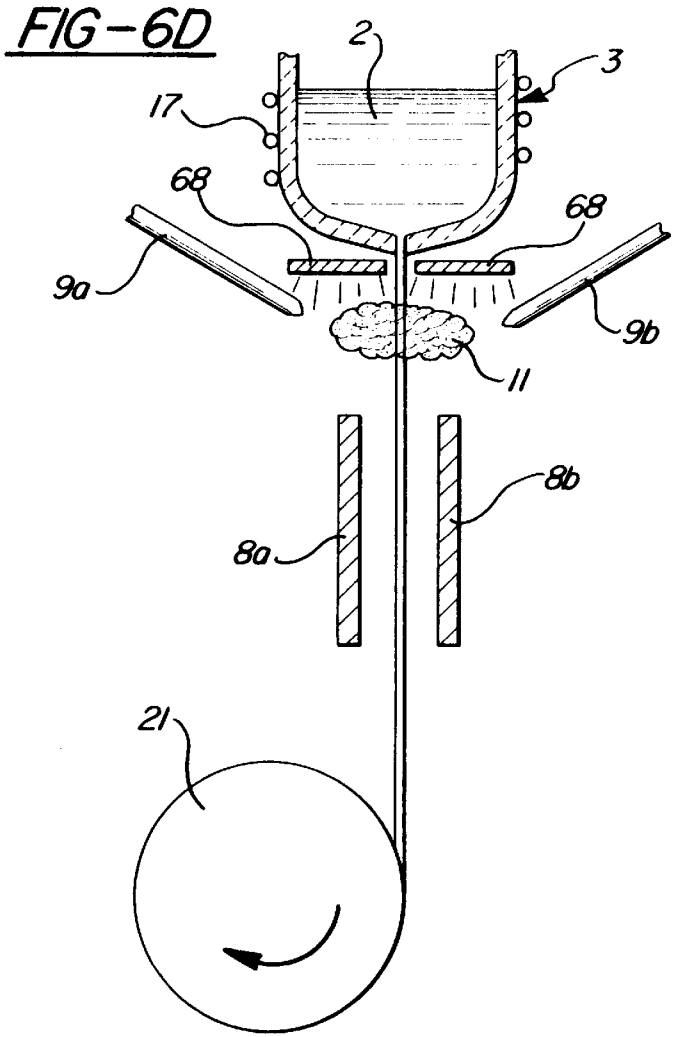
Figure 6C:
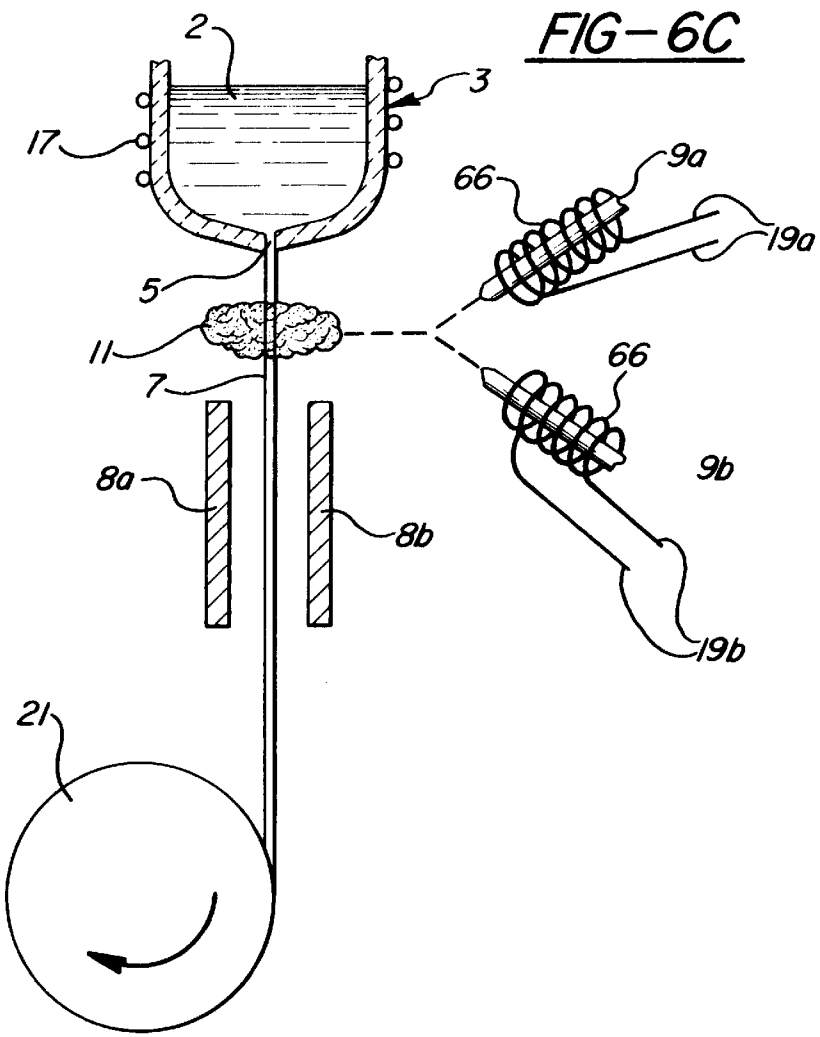

FIG. 6C illustrates apparatus for thermally activating the gaseous components of the engineered material. As is shown in FIG. 6C, each of the two nozzles 9*a* and 9*b* has associated therewith a coiled resistance heating element 66 for providing thermal energy to the gaseous components ejected from the nozzles 9*a* and 9*b*. Although not shown in the figures, the nozzles 9*a* and 9*b* could also be modified to include therein a catalytic body such as a body of platinum or palladium for purposes of catalytically activating the gases passing therethrough.

Referring now to FIG. 6D there is shown apparatus adapted for the photochemical activation of the gaseous components provided by the nozzles 9*a* and 9*b*. The apparatus of FIG. 6D includes a pair of light sources 68 operatively disposed so as to illuminate the components exiting from the nozzles 9*a* and 9*b*. The light source most typically provides high intensities of wavelengths suitable for the activation of the component material. It may include well known photochemical sources such as mercury vapor lamps, sodium lamps, arc lamps, and lasers.

IV. Synthesis of Mg-Based Alloys

Magnesium based alloys, particularly ones adapted for hydrogen storage are well suited for fabrication by the processing techniques described herein.

An example of an MgNi based alloy is the following:

$$(Mg_xNi_{1-x})_aM_b$$

where, M represents at least one modifier element chosen from the group consisting of Ni, Co, Mn, Al, Fe, Cu, Mo, W, Cr, V, Ti, Zr, Sn, Th, Si, Zn, Li, Cd, Na, Pb, La, Mm, Pd, Pt, and Ca; b ranges from 0 to less than 30 atomic percent; and a+b=100 atomic percent of the alloy; $0.25 \leqq x \leqq 0.75$. This alloy is intended to encompass unmodified Mg alloys as well as modified Mg alloys.

With respect to the Mg-based hydrogen storage material, there is described the process of rapidly quenching multiple streams of material (such as a stream of Base Alloy and a stream of modifier elements) where the flow and quench rate of each of the multiple streams of material are independently controlled. This technique is particularly useful with modifier(s) of very low melting points (high vapor pressures) or with modifier(s) that have quite different mechanical/metallurgical characteristics as compared to those of the host MgNi material. The method disclosed herein differs from the teachings of the prior art by providing a modifying element(s) which can be introduced into the matrix so that it can enter thereinto with its own independent, separately controllable, quench rate. Thus the modifying element(s) can be frozen into the host matrix so as not only to enter the primary bonding of the material to become part of the alloy, but most importantly to be frozen into the alloy in a non-equilibrium manner.

Such modifying element(s) can be added by providing relative motion between the matrix and the modifying element(s), such as by providing one or more additional streams such as a second stream of material, directed from a second nozzle, in a metal spinning apparatus, the second nozzle being at the outlet of a reservoir of a fluid modifier material. Such second nozzle is arranged to direct the fluid modifier material toward the substrate in a stream which converges with the stream of metallic host matrix material being directed onto the substrate from a first nozzle at or before the host material makes contact with the substrate.

EXAMPLE

By employing the above described rapid solidifcation process, the instant inventors have produced electrochemical hydrogen storage materials (in particular, the aforementioned Mg-based alloy system, the TiNi-based alloy system and the LaNi-based alloy system disclosed hereinafter) having a higher density of defect sites than the number of active storage sites present in most previously produced materials (reaching defect densities up to $5\times10^{21}$/cc, $1\times10^{22}$/cc and even $5\times10^{22}$/cc). This is particularly useful because hydrogen can be stored in each one of those defect sites.

High defect density materials have been prepared by rapidly solidifying a molten material using melt spinning and thereafter grinding the solidified material to a powder. The melt spinning apparatus employs a boron nitride crucible and a copper beryllium chill wheel contained in an evacuated chamber continuously filled with argon at a rate of 1–10, preferably 2–8, or most preferably 3–5 liters per minute. Once the desired quantities of alloy components have been added to the boron nitride crucible, the crucible is heated to a temperature of 1000–2100° C., preferably 1200–1900° C., or most preferably 1450–1800° C.

The size of the orifice of the crucible, the wheel speed, the chill rate, and the pressure under which the melt is forced from the crucible are all interrelated, and control the formation of the microstructure in the materials of the present invention. Generally, these factors must be chosen so that the melt is sufficiently cooled while on the wheel to produce the desired high defect microstructure.

The temperature of the chill wheel can be any temperature from −273 to 90° C., preferably 0 to 75° C., and most preferably 10 to 25° C. The wheel itself preferably has a copper beryllium surface, although any high hardness, high melting point material unreactive to the molten stream may be used. The high defect density material are hydride forming alloys. The hydride forming alloy may be either stoichiometric or non-stoichiometric and may be either TiNi type alloys, $LaNi_5$ type alloys or mixtures thereof. While the alloys can be of any known prior art composition, typically they will contain both hydride-forming elements and modifier elements. For a typical TiNi type alloy, the hydride-forming elements may be selected from the group consisting of Ti, V, Zr and mixtures or alloys thereof and the modifier elements may be selected from the group consisting of Ni, Cr, Co, Mn, Mo, Nb, Fe, Cu, Sn, Ag, Zn, or Pd and mixtures or alloys thereof. Alternatively, for a typical $LaNi_5$ type alloy, the hydride-forming elements may be selected from the group consisting of Sc, Y, La, Ce, Pr, Nd, Sm, Mm and mixtures or alloys thereof and the modifier elements may be selected from the group consisting of Ni, Cr, Co, Mn, Fe, Cu, Sn, Mo, V, Nb, Ta, Zn, Zr, Ti, Hf, W and mixtures or alloys thereof.

The hydride forming alloy may further include at least one glass forming element selected from the group consisting of Al, B, C, Si, P, S, Bi, In, Sb and mixtures or alloys thereof. Specifically useful alloy compositions may include alloys selected from the group consisting of:

alloys represented by the formula $$ZrMn_wV_xM_yNi_z,$$

where M is Fe or Co and w, x, y, and z are mole ratios of the respective elements where $0.4\leqq w\leqq 0.8$, $0.1\leqq x\leqq 0.3$, $0\leqq y\leqq 0.2$, $1.0\leqq z\leqq 1.5$, and $2.0\leqq w+x+y+z\leqq 2.4$;

alloys corresponding substantially to the formula $$LaNi_5$$

in which one of the components La or Ni is substituted by a metal M selected from Groups Ia, II, III, IV, and Va of the Periodic Table of the Elements other than lanthanides, in an atomic proportion which is higher than 0.1% and lower than 25%;

alloys having the formula $$TiV_{2-x}Ni_x,$$

where x=0.2 to 0.6;

alloys having the formula $$Ti_aZr_bNi_cCr_dM_x,$$

where M is Al, Si, V, Mn, Fe, Co, Cu, Nb, Ag, or Pd, $0.1\leqq a\leqq 1.4$, $0.1\leqq b\leqq 1.3$, $0.25\leqq c\leqq 1.95$, $0.1\leqq d\leqq 1.4$, $a+b+c+d=3$, and $0\leqq x\leqq 0.2$;

alloys having the formula $$ZrMo_dNi_e$$

where d=0.1 to 1.2 and e=1.1 to 2.5;

alloys having the formula $$Ti_{1-x}Zr_xMn_{2-y-z}Cr_yV_z$$

where $0.05\leqq x\leqq 0.4$, $0\leqq y<1.0$, and $0<z\leqq 0.4$;

alloys having the formula $$LnM_5$$

where Ln is at least one lanthanide metal and M is at least one metal chosen from the group consisting of Ni and Co;

alloys comprising at least one transition metal forming 40–75% by weight of said alloys chosen from Groups II, IV, and V of the Periodic System, and at least one additional metal, making up the balance of said electrochemical hydrogen storage alloy, alloyed with the at least one transitional metal, this additional metal chosen from the group consisting of Ni, Cu, Ag, Fe, and Cr—Ni steel;

alloys comprising a main texture of an Mm-Ni system; and a plurality of compound phases where each compound phase is segregated in the main texture, and wherein the volume of each of the compound phases is less than about 10 $\mu m^3$; and alloys having a the composition: (Ovonic Base Alloy) $_aM_b$; where Ovonic Base Alloy represents an Ovonic alloy that contains 0.1 to 60 atomic percent Ti, 0.1 to 50 atomic percent Zr, 0.1 to 60 atomic percent V, 0.1 to 60 atomic percent Ni, and 0.1 to 56 atomic percent Cr, as described above;

a is at least 70 atomic percent;

M represents at least one modifier chosen from the group consisting of Co, Mn, Al, Fe, W, La, Mo, Cu, Mg, Ca, Nb, Si, and Hf;

b is 0 to 30 atomic percent;

b>0; and a+b=100 atomic percent.

Alloys were prepared having the specific formulae set forth below in Table 1, which are covered by the generic composition in atomic percent: 0.5–2.0% V; 7.0–8.5% Cr; 6.0–8.0% Ti; 20–35% Zr; 0.0–0.5% Fe; 15–25% Mn; 1.5–3.0% Co; 25–40% Ni; and 0.01–2.0% Mg.

TABLE 1

| Alloy | Alloy Compositions in Atomic Percent | | | | | | | | |
|---|---|---|---|---|---|---|---|---|---|
| Number | V | Ti | Zr | Ni | Co | Cr | Fe | Mg | Mn |
| 1 | 1.3 | 7.8 | 29.2 | 31.6 | 2.4 | 7.8 | 0.12 | 0.3 | 19.3 |
| Conventional Cast | 1.4 | 7.5 | 28.9 | 32.7 | 2.5 | 7.7 | — | — | 19.3 |

Raw materials in powder form following the compositions set forth above in Table 1 were put into a boron nitride crucible heated to a temperature of about 1050° C. This crucible had a 0.97 mm orifice through which the melt was injected onto a fast spinning copper beryllium wheel (turning at around 26 m/s). The wheel was cooled by continuously running water at 17° C. The crucible and wheel where enclosed in a chamber that was pumped down and then filled with argon supplied at the rate of 3–5L/min.

The resulting ribbons and flakes collected at the bottom of the chamber. These were ground for 30–90 minutes. The final powder has a particle size of about 200 mesh. These materials were then pressed onto a nickel wire screen and compacted to form disordered negative electrodes. These disordered negative electrodes were assembled into cells. These cells were cycled and the results are presented in Table 2, below and compared to the same alloy (as above) prepared by conventional casting.

TABLE 2

| Alloy Number | initial capacity (mAh/g) | cycling capacity (mAh/g) |
|---|---|---|
| 1 | 535 | 556 |
| Conventional Cast | 340 | 340 |

When analyzed, the alloy materials having greatly enhanced storage capacity where shown to have many differences from those having "normal" capacity. One such difference can be seen in the crystallite size of the materials. The microstructure of these materials was analyzed using x-ray diffraction (XRD). The material of sample 2 has an average crystallite size of about 120 Å. Additional data from SEM indicates that the crystallite size of the powder may be even smaller than 120 Å and may be as low as 50 Å or even less. This difference in crystallite size may have a substantial effect on storage capacity. It may be that these small crystallites contribute non-conventional storage sites (i.e. surface state sites, crystallite boundary sites, etc.) Therefore, the hydrogen storage material is preferably a compositionally or structurally disordered, multi-component material having a crystalline size on the order of less than about 200 Å, and more preferably on the order of less than about 150 or 125 Å. Most preferably the crystallites are on the order of less than about 100 or 50 Å. This nanocrystalline microstructure exhibits useful intermediate range order.

Another difference may be see by scanning electron microscope (SEM) pictures. The material of sample 2 is highly uniform with both catalytic and storage phases intimately mixed throughout. This high uniformity allows for better utilization of the storage material. Therefore, the hydrogen storage material is preferably multi-phase and contains both catalytic phases and hydrogen storage phases which are intimately mixed in close proximity to each other. It is also possible that the more uniform microstructure indicates more uniform cooling and possibly a higher defect density than sample 1.

It should now be clear that by controlling the various properties and configurations of the modified material, the electrical, chemical, thermal or physical characteristics, such as the three dimensional bonding and anti-bonding relationships and positions are not normally seen in crystalline materials, at least not in large and controllable numbers. This is especially true for a d band or multiple orbital modifier element. The d band or multiple orbital modifier elements enable the modified materials to have stable, but non-equilibrium orbital configurations frozen in by the independently controllable quench rate.

In a melting process, the relationship and cooling rate of the matrix and added modifier element(s) would allow the added element to be incorporated in the normal matrix structural bonds. The timing of the introduction of the modifier element(s) can be controlled independently of any crystalline constraints. The flow rate of the modifier element can be controlled and may be varied or intermittent and may incorporate gaseous modifier element(s) in the stream or environment. By independently controlling the environment, quench and flow rates and timing a new bulk material or alloy can be formed with the desired properties, which does not have a counterpart in crystalline materials.

By quenching the modified molten metal or molten metallic alloy, at a high quenching rate, a modified highly disordered ribbon can be attained which, because it has been frozen in the amorphous as opposed to the crystalline state, and which is modified, will have a significant number of disassociation points for molecules and bonding points, i.e., high valence atoms with many unfilled or unconnected valence positions, which provide bonding points for free atoms of a gas so that the material has utility in storing gases and which can provide a material that can simulate the catalytic chemical properties of a metal or host matrix.

Many modifications can be made to the method of the present invention without departing from the spirit and teachings of the subject disclosure. Accordingly, the scope of the invention is only to be limited by the claims which follow.

What is claimed is:

1. A method of fabricating a synthetically engineered material having at least a first melting point component adapted to function as a host matrix for the engineered material, and a second high vapor pressure component, said method including the steps of:

melting the first high melting temperature component to form a molten first component;

providing a fluidic stream of said molten first component;

subjecting the fluidic stream of the first component to an energized, diffusible second high vapor pressure component of the engineered material presented as a spray or gaseous cloud about said fluidic stream; and diffusing said second component through at least a portion of the fluidic stream, whereby the second component interacts with the first component so as to deposit a layer of synthetically engineered solid material, exhibiting a range of properties different from the properties of either individual component.

2. A method as in claim 1, wherein the step of providing a fluidic stream of a first component comprises the step of providing a fluidic stream of the first component formed from the same material in each of a plurality of deposition stations.

3. A method as in claim 2, further including the step of forming the second component from the same material in each of a plurality of discrete deposition stations.

4. A method as in claim 2, including the further step of forming the second component in discrete deposition stations disposed downstream of the fluidic stream, said second component deposited in at least one of the deposition stations differing in composition from the material deposited in other of said deposition stations.

5. A method as in claim 1, including the further step of forming said first component in at least one of said deposition stations of a material differing in composition from the first component in the other of said deposition stations.

6. A method as in claim 1, wherein the step of providing a fluidic stream of a first component comprises the step of providing a stream of an atomized metallic material.

7. A method as in claim 6, wherein the step of subjecting the fluidic stream of the first component to an energized, diffusible second component comprises the step of directing a stream of energized gaseous high vapor pressure material to impinge upon the fluidic stream of the first component.

8. A method as in claim 7, wherein the step of subjecting the fluidic stream of the first component to an energized, diffusible second component, comprises the step of directing the fluidic stream of the first component through a plasma containing the second component.

9. A method as in claim 8, wherein the step of energizing the second component comprises ionizing, radicalizing, thermally, catalytically, or optically activating said second component of the synthetic material.

10. A method as in claim 7, including the further step of maintaining contact between the fluidic stream and the energized gaseous stream for a sufficient length of time to obtain a desired degree of diffusion of the second component into the fluidic stream of the first component.

11. A method as in claim 1, including the further step of providing the second component in a high pressure environment.

12. A method as in claim 1, wherein the step of providing a fluidic stream of a first component includes the steps of:

melting said first component in a crucible; and ejecting said first component from said crucible in a fluidic stream.

13. A method as in claim 1, wherein the step of providing a fluidic stream of a first component including the step of ejecting said first component through a nozzle under pressure.

14. A method as in claim 1, further including the step of subjecting said fluidic stream of said first component to at least one burst of energy for enhancing diffusion of said second component through at least a portion of the fluidic stream of the first component.

15. A method as in claim 14, including the further step of utilizing electromagnetic energy so as to establish eddy currents within said fluidic stream of the first component.

16. A method as in claim 14, including the further step utilizing thermal energy so as to promote said diffusion.

17. A method as in claim 1, including the further step of subjecting the fluidic stream of the first component to an energized, diffusible third component.

18. A method as in claim 17, wherein the step of subjecting the fluidic stream of the first component to the third component includes the further step of providing said third component as an energized, fluidic stream.

19. A method as in claim 17, including the further step of sequentially exposing the fluidic stream of said first component to said second and said third energized diffusible components.

20. A method as in claim 17, including the further step of simultaneously subjecting the fluidic stream of said first component to the second and the third energized, diffusible components.

21. A method as in claim 1, further including the step of directing said fluidic stream of said first component after being modified by said second component onto a quench surface.

* * * * *